US005387145A

United States Patent [19]

Wagner

[11] Patent Number: 5,387,145

[45] Date of Patent: Feb. 7, 1995

[54] SWIM FINS

[76] Inventor: John L. Wagner, 1212 H. St., SP193, Ramona, Calif. 92065

[21] Appl. No.: 88,515

[22] Filed: Jul. 7, 1993

[51] Int. Cl.[6] ..... A63B 31/08

[52] U.S. Cl. ..... 441/64

[58] Field of Search ..... 441/61-64; 472/128; D21/239

[56] References Cited

U.S. PATENT DOCUMENTS

| | | | |
|---|---|---|---|
| 2,889,563 | 6/1959 | Lamb et al. | 441/64 |
| 3,055,025 | 9/1962 | Ferraro | 441/64 |
| 3,183,529 | 5/1965 | Beuchat | 441/64 |
| 3,422,470 | 1/1967 | Mares | 441/64 |
| 3,649,979 | 3/1972 | MacNiel | 441/64 |
| 3,908,213 | 9/1975 | Hill | 441/64 |
| 3,913,158 | 10/1975 | Vilarrubis | 441/64 |
| 3,922,741 | 12/1975 | Semela | 441/64 |
| 4,083,071 | 4/1978 | Forjot | 441/64 |
| 4,627,820 | 12/1985 | Penebre | 441/64 |
| 4,775,343 | 10/1988 | Lamont/Chapelas | 441/64 |
| 4,923,419 | 5/1990 | McCarthy | 441/64 |

*Primary Examiner*—Edwin L. Swinehart

[57] ABSTRACT

A foot mounted fin for use by body surfers, divers, and swimmers in water activities of all types. The strap of the swim fin fits around the ankle while the fin blade extends out beyond the foot. There is a scoop section designed to take in water at the top of the fin near the foot. Scoop discharge ports for discharging water is at the blade tip. The scoop section also channels the water to eyelet ports formed into the fin blade, enabling it to discharge water out and over the bottom surface of the fin blade while at the same time releasing it at the blade tip. This combines the forces of the two jet streams of water. This fin works with wave turbulence and ocean currents enabling the body surfer, diver and/or swimmer to fully utilize the power potential from the ocean on his/her behalf. Included in this is the swim fin mold design for efficient production of the swim fin.

6 Claims, 4 Drawing Sheets

SWIM FINS

BACKGROUND

1. Field of Invention

This invention relates to swim fins, a foot-mounted fin for use by body surfers and other swimmers and divers.

2. Description of Prior Art

Swim fins are designed to increase the swimmers mobility and speed in the water while at the same time reducing the amount of energy required to be expended.

Originally swim fins were designed to mimic the fins or flippers of aquatic animals. They were generally made of a solid piece of rubber or plastic that contained some means of attachment to the foot. While these designs did increase the power of the swimmer's thrusting motion, they did not maximize the hydrodynamic principals involved.

Later designs such as U.S. Pat. No. 3,649,979 to Mac Niel (1972), U.S. Pat. No. 3,913,158 to Vilarrubis (1970), U.S. Pat. No. 4,083,071 to Forjot (1978) and U.S. Pat. No. 4,627,820 to Penebre (1985) included different types of "scoop" portions to take in water, allowing it to pass through the fin and be released at the tip of the fin or close to it. Although this is an improvement, it still does not provide for efficient channeling of the water to the back side or bottom surface of the fin while at the same time releasing it at the tip. This flaw prevents the swimmer from fully utilizing the power potential of the water flow over the surface area of the fin.

U.S. Pat. No. 3,183,529 to Beuchat (1965), U.S. Pat. No. 3,055,025 to Ferraro (1962), U.S. Pat. No. 3,422,470 to Mares (1967), U.S. Pat. No. 3,922,741 to Semela (1974) and U.S. Pat. No. 4,775,343 to Lamont and Chapelas (1988) are designed to channel water to the back side or bottom of the fin. However, without a specialized portion of the fin to actively direct the water to the channels, these designs fail to deliver the maximum use of water power to the swimmer. Also, some of these types of fins are too big and bulky for effective use by swimmers and body surfers.

All of the swim fins previously known suffer from a number of disadvantages:

(a) Previous designs fail to channel the water effectively and therefore do not maximize the effect of the water flow over the entire available surface of the fin.

(b) Many previous designs are too big and bulky, reducing the swimmer's mobility in the water and requiring unneeded expenditures of energy.

(c) Some designs are too short, failing to provide maximum stroke efficiency in the water.

(d) Some designs are too complex, resulting in a cumbersome device that defeats the basic purpose of the fin by decreasing mobility and agility in the water.

(e) Some fins are designed to be used exclusively by divers while others can be used only by swimmers, necessitating buying different fins for each activity.

(f) No previous designs provide any means for reducing the natural friction that occurs between the user's foot and the fin which can cause abrasions along the wearer's toes and foot.

AIMS AND ADVANTAGES

Several aims and advantages of the present invention are:

(a) The addition of a scoop or bridge portion across the top part of the fin forces the water through the main body of the fin and releases it at the tip of the blade portion and at the same time guides it to the eyelet channels to be released out the back side or bottom surface area of the swim fin. This design makes the optimum use of the flow of water by directing jet streams of water over all surfaces of the fin, giving the swimmer increased power with each kick stroke while at the same time reducing the amount of energy output required.

(b) Having the water intake further down the face of the fin and farther away from the foot portion results in increasing the amount of water the fin is able to take in, and discharge at the tip of the fin blade.

(c) Extending the scoop or bridge portion past the main body of the fin has the effect of combining the force of the jet stream of water from the eyelet channels with the jet stream of water from the bridge or scoop, thereby increasing the amount of energy released at the tip of the fin blade.

(d) Eyelet channels formed into the main body of the fin just below the foot area and traveling towards the tip of the fin in a row on both sides of the center rib increase the efficiency of the fin by utilizing the flow of water or ocean current and directing it to the back surface area of the fin.

(e) The seven embodiments of this fin can be designed in different lengths, enabling the swimmer or diver to choose which style would most improve his/her agility in the water.

(f) The special lining of the foot chamber with a polyurethane product with a shore hardness of 5–20 acts as a chushion and reduces friction along the swimmer's foot thereby resulting in a more comfortable fit and eliminating abrasions caused by friction with the stiffer blade rubber.

(g) This design offers all of the advantages of a complex system in a streamlined package.

BRIEF DESCRIPTION OF DRAWING FIGURES

In the drawings, closely related figures have the same number but different alphabetic suffixes.

FIGS. 1A and 1B show the top view of the fin including the water scoop portion that is affixed to the top of the blade, and shows where the water will be drawn in just below the foot and discharged at the blade tip. FIG. 1C shows the top view of the fin with the water scoop recessed back from the blade tip. FIG. 1D shows the top view of the fin without a water scoop portion but having eyelet channels.

FIGS. 2A, 2B and 2D show the bottom view of the fin and how the eyelet channels would be shaped into the main body of the fin blade, and indicates the location of the side and center ribs, the foot chamber and the sand escape ports. FIG. 2C shows the bottom view of the fin with the side and center ribs, but without the eyelet channels.

FIGS. 3A and 3B show side views of the fin, indicating the approximate angle the eyelet channels are set into the fin blade, the formation of the foot chamber, location of the sand escape ports, and the relation of the water scoop portion to the blade. FIG. 3C shows the side view of the fin with a recessed water scoop portion and without eyelet channels. FIG. 3D shows a side view of the fin without a water scoop portion.

FIG. 4A is a front view of the fin demonstrating the flow of water through the fin and how the scoop portion could be extended beyond the blade tip. FIG. 4B is a front view of the fin showing the scoop portion dramatically recessed back from the blade tip. FIG. 4C is a front view of the fin without the water scoop portion showing the eyelet channels.

Referring to FIGS. 1-3 the High Performance Swim Fin is generally comprised of a blade portion A, a foot portion B, and a bridge or water-scoop portion C. In the preferred embodiment, the entire swim fin is made in one continuous piece and is composed of rubber, polyurethane, or similar flexible material. This design can also be made from two different materials fused together; the blade being made of one flexible material and the scoop portion composed of a different flexible material.

Figure 5:
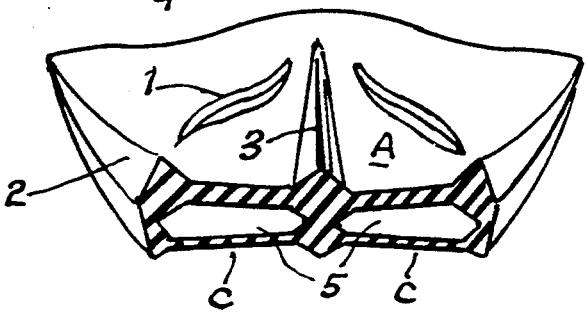
FIG. 5 shows a cross section bottom view of the blade portion with the eyelet channels, side and center ribs, how the water scoop portion goes across the blade and the contour of the water scoop intake ports.

The blade A is composed of a solid piece of natural rubber, polyurethane product with a shore hardness of 60-80, or a similar flexible material. The blade houses a foot portion B, eyelet channels 1, and supports the scoop portion C. The blade tapers down towards the tip of the fin. The blade has side and center ribs for extra support. The side rib sections 2 run parallel along the outer edge of the blade portion and the center rib 3 travels down the center line of the fin, beginning at the center of the foot section and extending toward the tip of the blade. The eyelet channels 1 are cut into the blade portion indicated in FIG. 2A, FIG. 2B and FIG. 5 at approximately a 30 degree angle. This design can accommodate two eyelet channels or up to eight, positioned in rows of up to four eyelets on both sides of the center rib. Sand escape ports 4 are formed into the blade at the foot chamber 7.

Figure 3A:
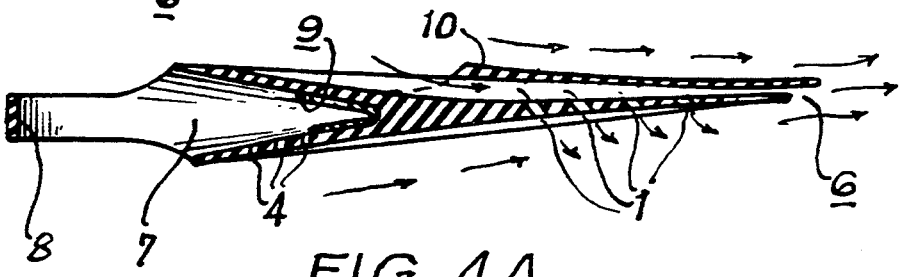
Figure 4A:
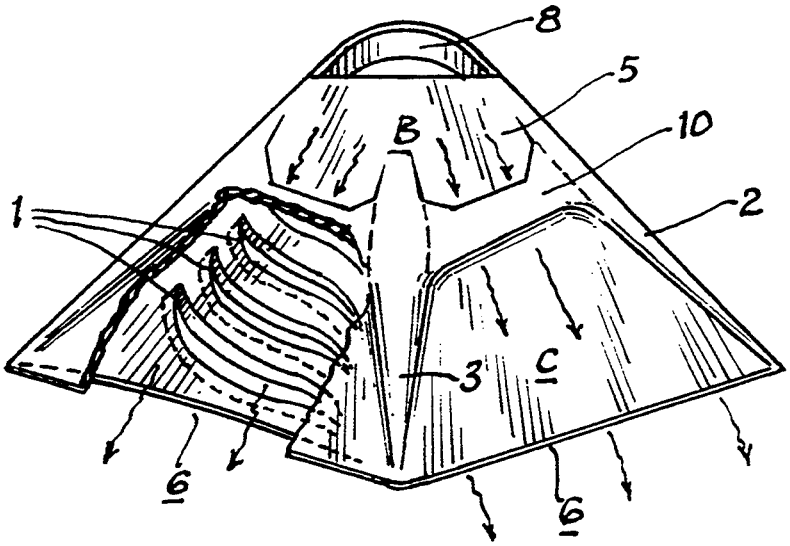
Figure 1B:
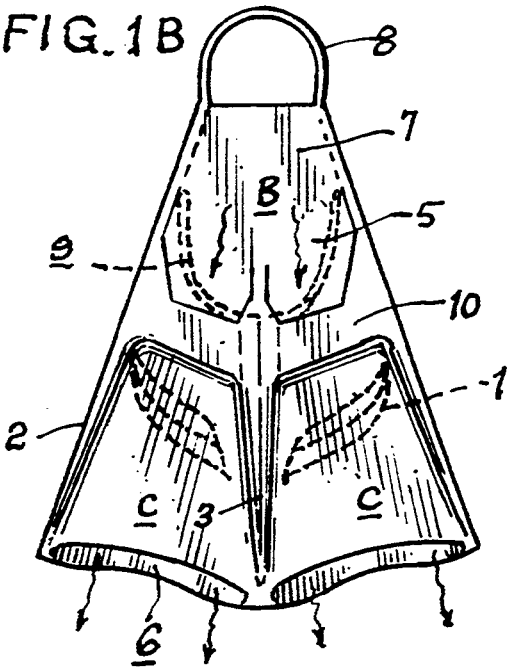
Figure 2B:
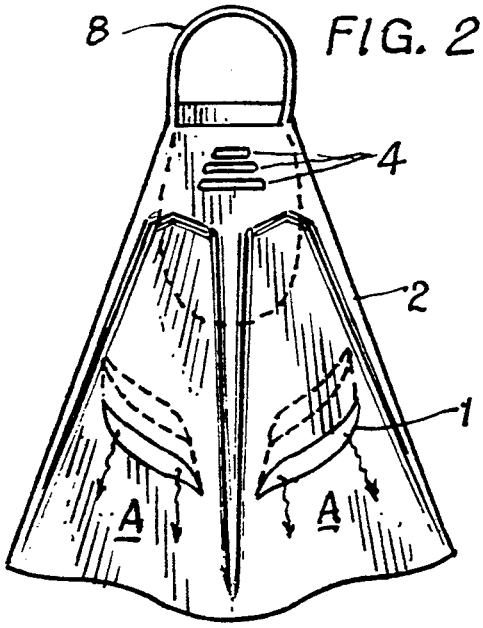
Figure 3B:
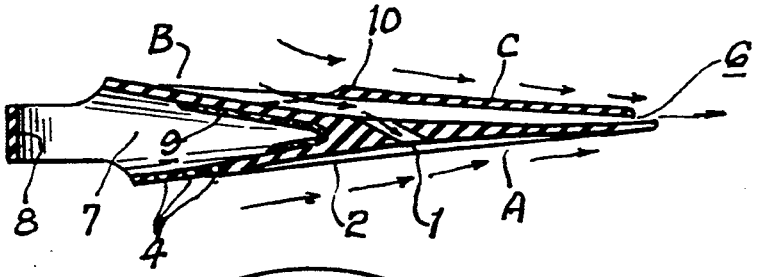
Figure 1C:
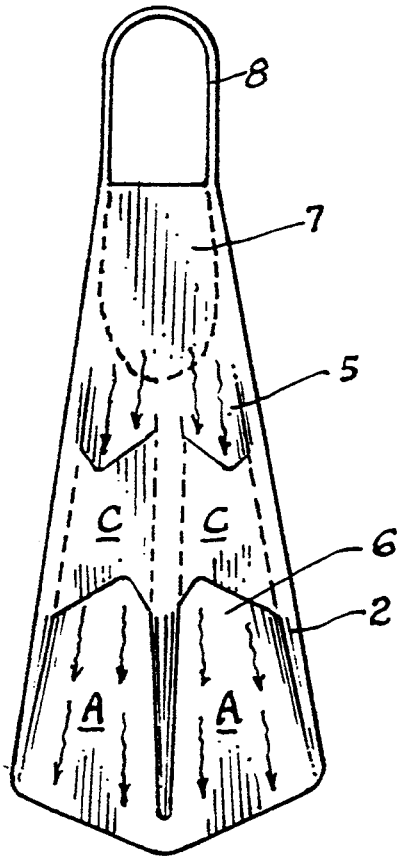
Figure 2C:
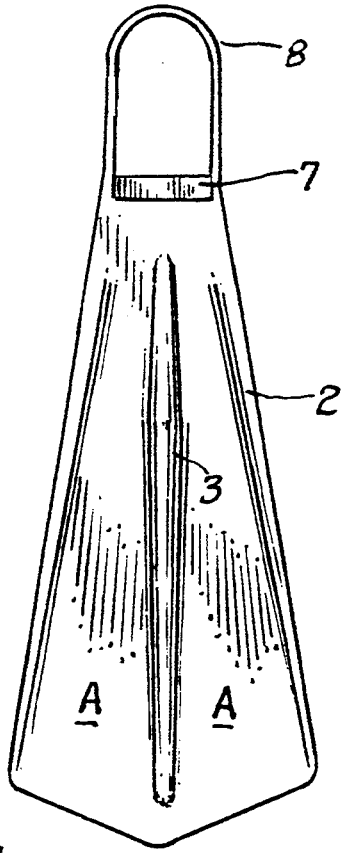
Figure 3C:
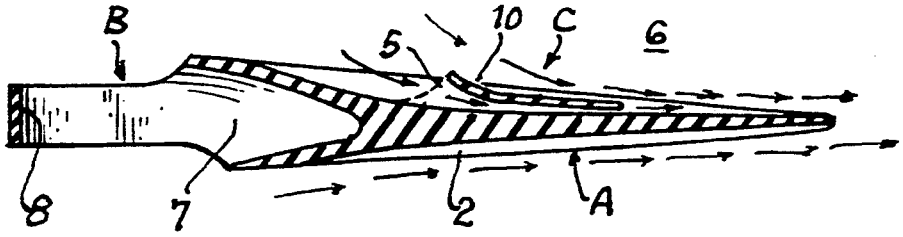
Figure 4B:
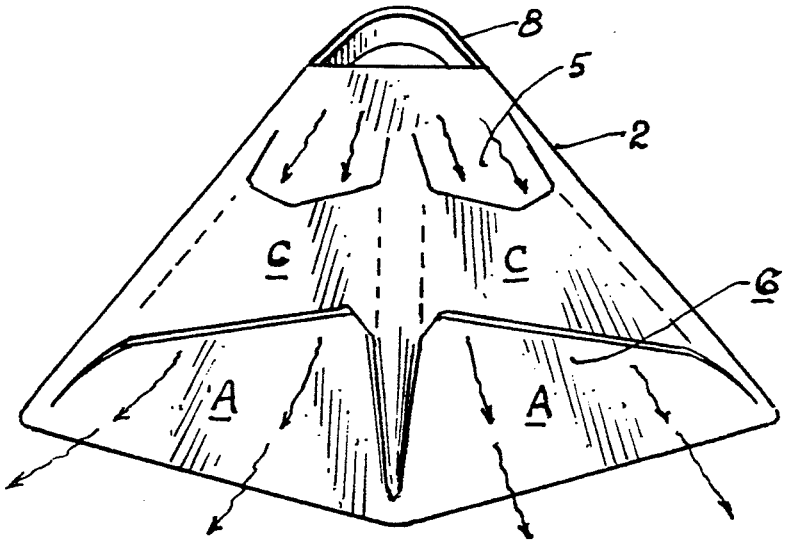
Figure 1D:
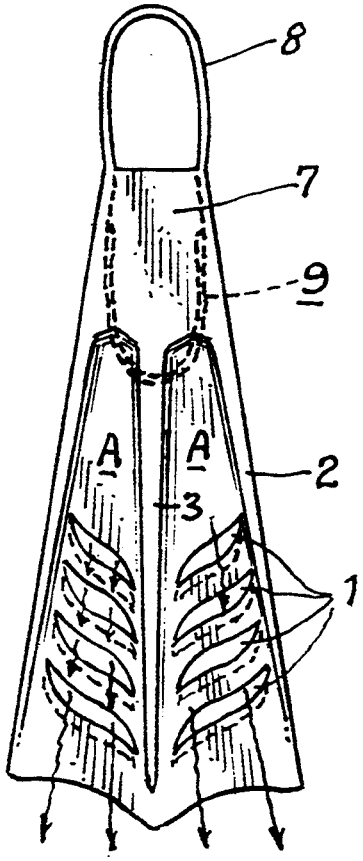
Figure 2D:
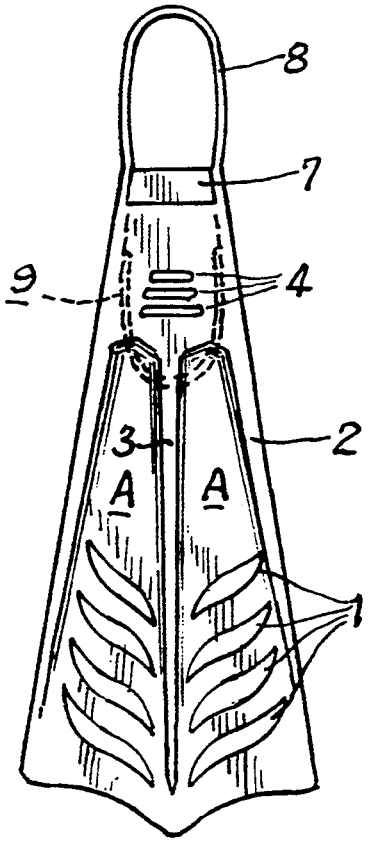
Figure 3D:
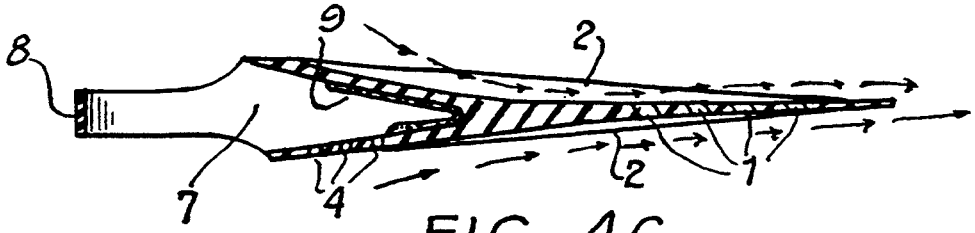
Figure 4C:
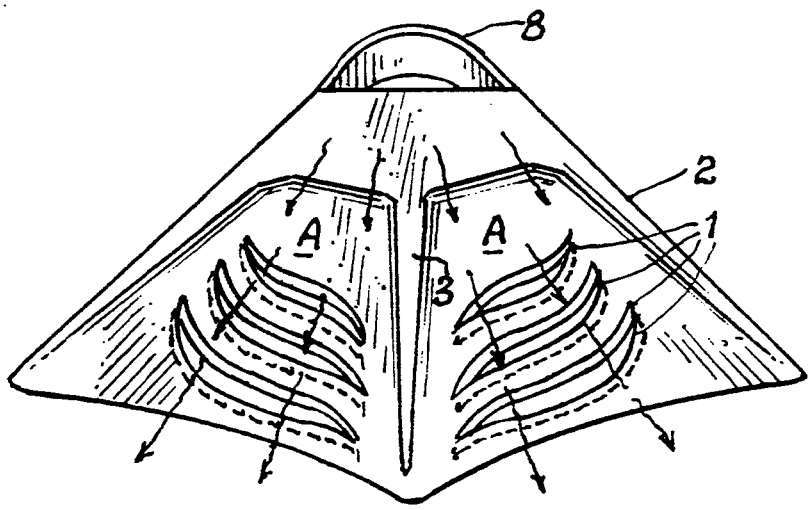

The water scoop portion C starts at the base of the foot chamber 7, extends across the tip of the fin and, depending on the model, either runs the full length of the blade, is recessed back from the tip of the blade as shown in FIG. 1C, FIG. 3C, and FIG. 4B, or may extend slightly beyond the blade tip. This scoop section is joined at the side and center rib sections, having relatively large openings or water scoop intake ports 5 at the top of the blade directly following the foot chamber 7 and tapering to long, narrow openings at the tip of the blade, the water scoop discharge ports 6. The water scoop, as shown in FIG. 3C, is beveled 10 slightly upwardly at the water intake ports and at the side and center ribs. This is also shown in FIG. 1A, FIG. 1B, FIG. 3A, FIG. 3B, and FIG. 4A.

The foot portion B is comprised of a foot chamber 7 formed from the top, bottom and side walls of the blade portion. The foot chamber lining 9 is comprised of a polyurethane product with a shore hardness of 5-20, or some other similar soft, flexible material. Sand escape ports 4 are formed in the bottom side of the foot chamber. A strap 8 made of one continuous piece of rubber is formed from to the blade of the fin and is designed to go around the ankle of the swimmer. The foot section can be made in different sizes.

This design can be made in many contemporary or translucent colors, including two or three toned colors, fading into one another or into clear or all clear.

FIGS. 1-4 inclusive demonstrate the operation of the High Performance Swim Fin by showing the way in which water flows through and over the fin during the swimmer's up and down strokes.

On the swimmer's downstroke the water is drawn in at the water scoop intake ports 5. The water is then channeled through the tapered scoop section and released at the narrower openings at the tip of the blade, the water scoop discharge ports 6. This results in creating a form of jet-propulsion from the flow of water adding power to the thrust of the swimmer. At the same time the water is forced through the eyelet channels 1, allowing the water to be channeled to the back surface of the fin on the swimmer's upstroke. The combination of the jet streams of water released at the water scoop discharge ports 6 and eyelet channels 1 increase the amount of thrust at the tip of the blade and give the swimmer maximum utilization of the water flow or ocean current on both up and down strokes.

The foot chamber lining 9 in the foot chamber protects the swimmer's foot from abrasions caused by friction between the foot and the fin and results in added comfort and safety for the swimmer.

SUMMARY RAMIFICATIONS AND SCOPE

The High Performance Swim Fin of this invention delivers maximum power to the swimmer, diver or body-surfer that uses it. In addition it requires less expenditure of energy the user. Furthermore, this swim fin has the addition advantages in that

- it increases the amount of water flowing over the surface areas of the fin resulting in added thrust
- it channels water to the back side of the fin thereby utilizing the top and bottom surface areas of the fin simultaneously
- it increases the user's mobility in the water
- it is a complex system in a streamlined design
- it increases the safety and comfort of the user by providing a cushioned foot chamber to overcome the natural friction between the foot and the fin
- it over comes the limitations of previous designs.

Figure 1A:
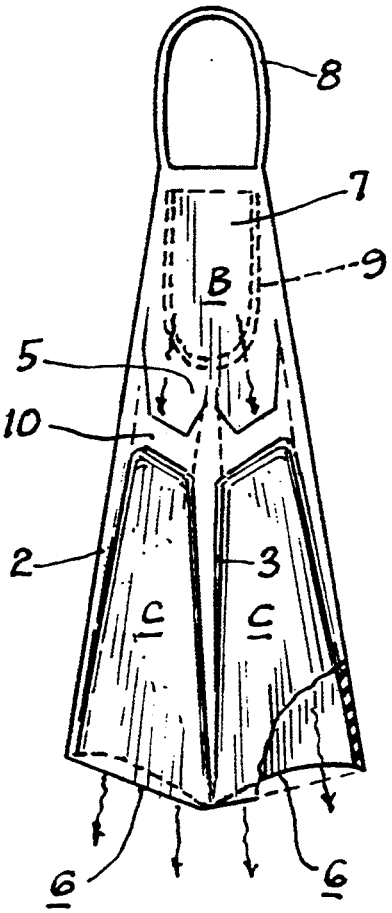
Figure 2A:
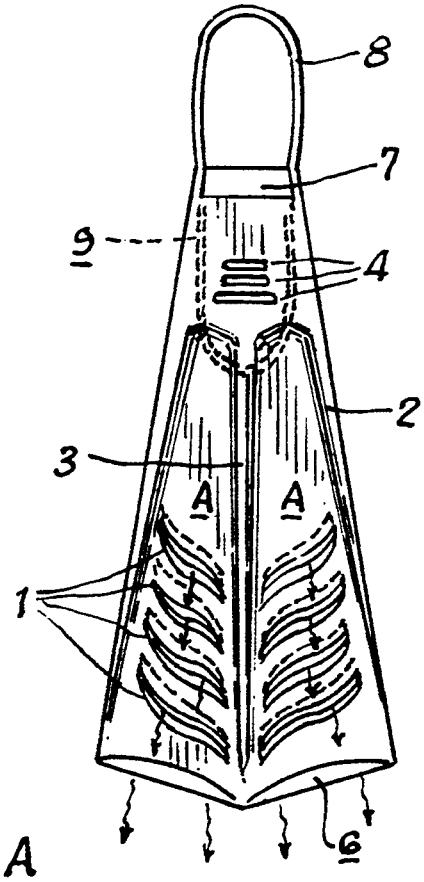
Figure 6:
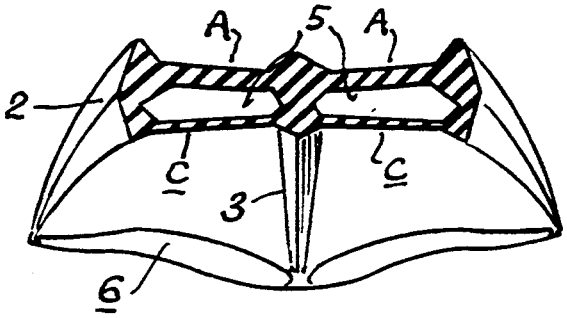
FIG. 6 shows a cross section top view of the blade portion and the water scoop portion, side and center ribs, and the contour of the water scoop intake ports.
Figure 7:
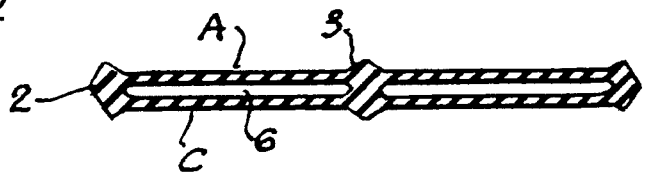
FIG. 7 shows a cross section view of the area where the blade portion and water scoop portion meet to form the water scoop discharge ports at the tip of the blade.

Although the description above contains many specifications, these should not be construed as limiting the scope of the invention but as merely providing illustrations of some of the presently preferred embodiments of this invention. For example the fin can be made with just the water scoop portion without the eyelet channels as shown in FIG. 1C, 2C, 4B and 3C, or can be made with just the eyelet channels without the scoop portion as shown in FIGS. 1D, 2D, 4C, and 3D. The water scoop portion can be dramatically recessed back from the tip of the blade as shown in FIGS. 1C, 4B, and 3C, or can be slightly recessed back from the tip of the blade as shown in FIGS. 1B, 3B and 6, or can extend slightly beyond the tip of the blade as shown in FIGS. 1A, 2A, 3A, 4A. The eyelet channels can vary in number from only two, as shown in FIGS. 1B, 2B, 3B and 5, up to eight as shown in FIGS. 2A, 4A, 3A. The fin can be made in a short, wide version or a long, narrow version. The fin can be made in two pieces, with the scoop comprised of one material and the fin blade comprised of a different flexible material, and the two fused together or the entire swim fin can be made in one continuous piece. This fin can be made in contemporary or neon colors or translucent colors, with two or three colors fading into one another or into clear, or all clear.

Thus the scope of the invention should be determined by the appended claims and their legal equivalents, rather than by the examples given.

I claim:

1. A foot-mounted swimming aid comprising:

a. a hollow foot chamber open at the heel having an exterior surface of flexible material and of sufficient size to accommodate a human foot and ending in an elongated strip of flexible material to go around the ankle and having a ventral lining of soft flexible material having a series of elongated holes to vent the chamber;

b. a blade portion of flexible material which is relatively stiffer than the flexible material of said foot chamber that connects to said foot chamber and extends past the foot chamber and broadens and tapers outward toward the end forming a flexible triangular shaped web having thickened support areas along the sides and in the center to add support and tapering downwards towards the end and in between said thickened support areas hollowed-out sections in the shape of curved, elongated slots set at two different angles in the triangular web; and c. a thin layer of flexible material extending from the beginning of the blade portion across the top of the blade generally to the end of the blade and connected to the blade at the thickened support areas creating openings between the side and center support areas and in between said thin layer that goes across the top and the blade portion thereby directing water to the elongated curved slots.

2. The invention as claimed in claim 1, in which said curved elongated slots are cut or molded into the triangular web in rows of up to four curved elongated slots on each side of the center thickened support area, totalling either curved elongated slots, set at a first angle to the center thickened support area and sloped toward the foot chamber at a second angle.

3. The invention as claimed in claim 1, in which said thin layer of flexible material extending across the top of the blade portion is joined at the side and center thickened support areas having relatively large openings at the top of the blade for the intake of water and tapering to long, narrow openings at the end of the blade.

4. The invention as claimed in claim 1, in which said thin layer of flexible material extending across the top of the blade can be recessed back from the end of the blade.

5. The invention as claimed in claim 1, in which said thin layer of flexible material extending across the top of the blade can extend slightly beyond the end of the blade.

6. The invention as claimed in claim 1, in which the thin layer of flexible material extending across the top of the blade creates a trapezoidal shaped opening near the foot chamber for the intake of water and a triangular shaped opening at the blade end for the release of water.

* * * * *